US010287742B2

(12) United States Patent
Tappe et al.

(10) Patent No.: US 10,287,742 B2
(45) Date of Patent: May 14, 2019

(54) NON-WELDED METAL FOUNDATION

(71) Applicants: James E Tappe, Zelienople, PA (US); Gary L Reinert, Carnegie, PA (US)

(72) Inventors: James E Tappe, Zelienople, PA (US); Gary L Reinert, Carnegie, PA (US)

(73) Assignee: Gary L. Reinert, Carnegie, PA (US)

( * ) Notice: Subject to any disclaimer, the term of this patent is extended or adjusted under 35 U.S.C. 154(b) by 275 days.

(21) Appl. No.: 14/827,477

(22) Filed: Aug. 17, 2015

(65) Prior Publication Data

US 2016/0040386 A1 Feb. 11, 2016

Related U.S. Application Data

(63) Continuation of application No. 13/907,121, filed on May 31, 2013, now abandoned.

(60) Provisional application No. 61/653,781, filed on May 31, 2012.

(51) Int. Cl.

| | |
|---|---|
| ***E02D 27/00*** | (2006.01) |
| ***E02D 27/02*** | (2006.01) |
| ***E02D 5/04*** | (2006.01) |
| ***E02D 27/08*** | (2006.01) |
| ***E02D 27/32*** | (2006.01) |
| ***E02D 31/10*** | (2006.01) |

(52) U.S. Cl.

CPC ..... *E02D 27/02* (2013.01); *E02D 5/04* (2013.01); *E02D 27/00* (2013.01); *E02D 27/08* (2013.01); *E02D 27/32* (2013.01); *E02D 31/10* (2013.01); *E02D 2250/00* (2013.01); *E02D 2300/0026* (2013.01)

(58) Field of Classification Search

CPC ..... E02D 5/04; E02D 5/06; E02D 5/08
USPC ..... 405/229, 280
See application file for complete search history.

(56) References Cited

U.S. PATENT DOCUMENTS

| | | | | | |
|---|---|---|---|---|---|
| 1,590,302 | A | * | 6/1926 | Lindenlauf | E02D 5/02 |
| 1,681,593 | A | * | 8/1928 | Pahl | E02D 5/02 |
| 1,690,499 | A | | 11/1928 | Nolte | |
| 1,975,534 | A | | 10/1934 | Brusch | |
| 2,454,956 | A | * | 11/1948 | Young | E02D 5/60 204/196.18 |
| 3,788,389 | A | | 1/1974 | Waters | |
| 4,110,990 | A | | 9/1978 | Thompson et al. | |
| 4,259,820 | A | * | 4/1981 | Kita et al. | E04B 1/76 |

(Continued)

FOREIGN PATENT DOCUMENTS

| | | |
|---|---|---|
| WO | WO/2016/100343 | 6/2016 |
| WO | WO/2016/100345 | 6/2016 |
| WO | WO/2016/100357 | 6/2016 |

*Primary Examiner* — Tara Mayo-Pinnock
(74) *Attorney, Agent, or Firm* — Blynn L. Shideler; Krisanne Shideler; BLK Law Group

(57) ABSTRACT

A non-welded metal foundation includes a plurality of bodies formed of metal plates or metal sheets, each body being comprised of lateral ends with integrated planar fins, wherein each of the metal lateral ends overlap a lateral end of an adjacent body; a plurality of mechanical fasteners along each of the overlapped ends of adjacent bodies for mechanically fastening the bodies having the integrated planar fins; wherein said plurality of said bodies are configured for forming a closed perimeter of a geometrical shape having an open interior and wherein the integrated planar fins of each body extend away from the perimeter of the closed geometric shape along the plane of the fin.

4 Claims, 2 Drawing Sheets

(56) References Cited

U.S. PATENT DOCUMENTS

| | | | | |
|---|---|---|---|---|
| 5,570,975 | A | 11/1996 | Reinert | |
| 5,660,504 | A | 8/1997 | Reinert | |
| 5,733,068 | A | 3/1998 | Reinert | |
| 5,944,452 | A | 8/1999 | Reinert | |
| 7,278,803 | B1 * | 10/2007 | Moreau | E02D 5/08 |
| 7,621,098 | B2 | 11/2009 | Reinert | |
| 8,820,722 | B2 | 9/2014 | Reinert | |
| D769,468 | S | 10/2016 | Pope | |
| D769,469 | S | 10/2016 | Pope | |
| 2005/0232707 | A1 | 10/2005 | Reinert | |
| 2009/0165403 | A1 | 7/2009 | Reinert | |
| 2010/0319273 | A1 | 12/2010 | Reinert | |
| 2012/0050072 | A1 | 3/2012 | Reinert | |
| 2013/0322970 | A1 | 12/2013 | Tappe | |
| 2014/0237913 | A1 | 8/2014 | Reinert | |
| 2016/0168816 | A1 | 6/2016 | Pope | |

* cited by examiner

NON-WELDED METAL FOUNDATION

RELATED APPLICATIONS

This application a continuation of United States Patent Application Ser. No. 13/907,121, now abandoned, filed May 31, 2013, entitled "Non-Welded Metal Foundation", which published Dec. 5, 2013 as Publication 2013-0322970, which publication is incorporated herein by reference.

U.S. patent application Ser. No. 13/907,121 claims the benefit of U.S. Provisional Patent Application Ser. No. 61/653,781, filed May 31, 2012, and entitled "Non-Welded Metal Foundation" which is herein incorporated by reference.

BACKGROUND INFORMATION

1. Field of the Invention

The present invention relates to metal foundations and assembly thereof.

2. Background Information

Over the last several years, metal foundations have been used to provide support for many different types of structures, because they offer many advantages over concrete foundations. Once installed, metal foundations can be used to instantly provide support for a structure, unlike concrete foundations which require a significant amount of time to cure. Metal foundations also can be installed in any weather condition and on any terrain; they are less damaging to the environment and they are easily moved when compared to concrete foundations.

However the current metal foundations that are available have several disadvantages. Current metal foundations have fins that are not integrated into the metal foundation bodies and welding is used for assembly. Welding, either on site or offsite requires qualified people and special equipment. This adds to the expense of installing foundations. Usually because it is less expensive, the metal foundation bodies are welded together in a shop and then transported on to the worksite. Transporting pre-assembled metal foundations limits their size and shape. If the metal foundations necessary for a specific project are too large or awkward to transport, the individual pieces can be weld together on site. However, this increases the expense of installing metal foundations because all the necessary personnel and equipment must also be transported to the worksite. Welding also generates toxic fumes which is not healthy for people or environmentally friendly.

There is a need in the art to provide alternative metal foundations whose assembly does not require welding.

SUMMARY OF THE INVENTION

In order to overcome these deficiencies in the prior art, the present invention provides metal foundation bodies that are assembled together without welding. in the disclosed invention, the fins are part of the metal foundation body. The bodies of the metal foundation of the disclosed invention are assembled manually via the integrated fins by mechanical fastening. The metal foundations of the invention can either be a perimeter geometric shape, a radial geometric shape or if the job requires, both shaped foundations can be combined/used in conjunction with one another. The mechanical fastening means can be any known in the field including, but not limited to Huck Bolts, rivets, clips, bolts, studs and clamps. The advantage of the disclosed invention is that it only requires manual assembly and not welding. The manual assembly can be done by persons generally familiar with the construction field and no special equipment other than that necessary for mechanical fastening is needed. With the disclosed invention there is virtually no limitations on size and shape for a metal foundation, the design can be easily adapt to any engineering specification. The metal foundations of the disclosed invention can be pre-assembled and transported to the worksite for installation or they can be assembled onsite-at a cost much lower than welding onsite. Because the metal foundations of the disclosed invention are manually assembled, they are not a health hazard and they are more environmentally friendly than welded metal foundations.

The features that characterize the present invention are pointed out with particularity in the claims which are part of this disclosure. These and other features of the invention, its operating advantages and the specific objects obtained by its use will be more fully understood from the following detailed description taken together with the associated figures.

DESCRIPTION OF THE PREFERRED EMBODIMENTS

Metal foundations are better than concrete foundations because once installed, metal foundations can provide instant support for a structure on worksite. However, current metal foundations have the disadvantage in that they require welding. This adds to the added expense of installing metal foundations. Welding also produces toxic fumes which are unhealthy and bad for the environment. The disclosed invention eliminates the welding expense and hazards by providing for metal foundations that can be manually assembled. The metal foundations of the disclosed invention are manufactured with the fins integrated into the finished bodies. These metal foundations are assembled via the fins by any mechanical fastening known in the art including but not limited to Huck Bolts, rivets, clips, bolts, studs and clamps.

Figure 1A:
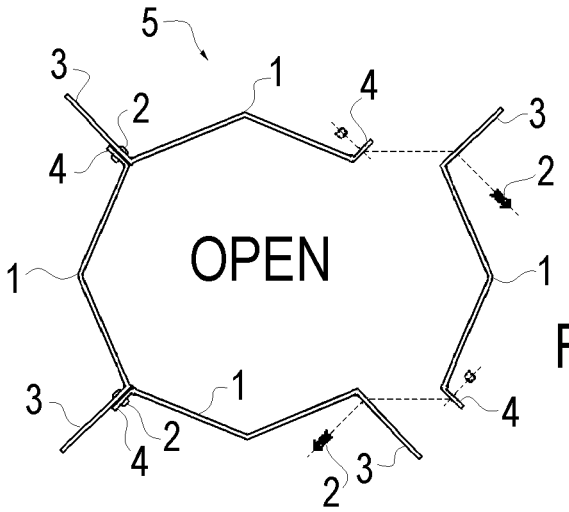
FIG. 1A is a top plan view, partially exploded, of one embodiment of a perimeter metal foundation.
Figure 1B:
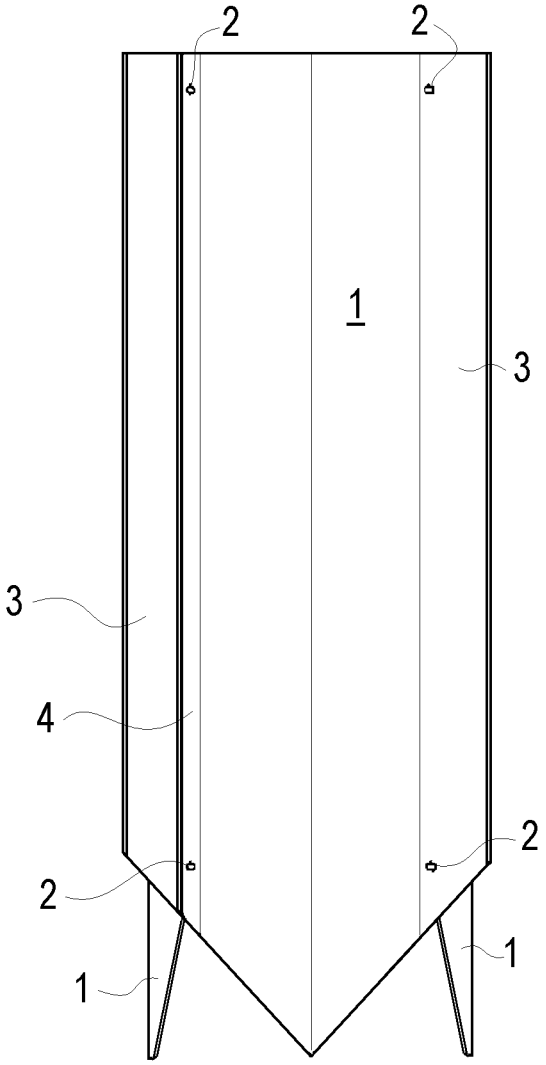
FIG. 1B is a longitudinal side elevation view of the embodiment of an assembled perimeter metal foundation of FIG. 1A.

FIG. 1 shows an embodiment for perimeter geometric shaped metal foundations, and in FIG. 1A a top view of an octagonal shape metal foundation is disclosed. At the ends of body 1 are long fins 3 and short fins 4. The individual bodies are assembled together by fastening means 2. However because the metal foundations of the disclosed invention is assembled out of bodies with integrated fins, the metal foundations can be any practical shape necessary; from a hexagon shape for a smaller foundation, to a virtually limitless number of sides to accommodate larger foundation designs. The size of the angle in the body 1 is dependent on the size of the foundation and the number of bodies necessary to accommodate the specific size. Larger foundations generally require more sides which increases the number of bodies necessary. The more bodies that are necessary the more obtuse can be the angle or the angle can be eliminated in favor of an arc to accommodate cylindrical designs. While FIG. 1A depicts bodies with short fins as well as long fins which lower the cost of the bodies, the invention also contemplates exclusively using long fins. To assemble the metal foundation, the fins from separate bodies are joined by any mechanical fastening means such as Huck Bolts, rivets, clips, bolts, studs clamps or any other feasible means known in the art. As depicted in the metal foundation 5 disclosed in FIG. 1B, the bottom of the foundation can be cut or mitered to any viable shape known in the art that is required to penetrate the earth for a specific project.

Figure 2A:
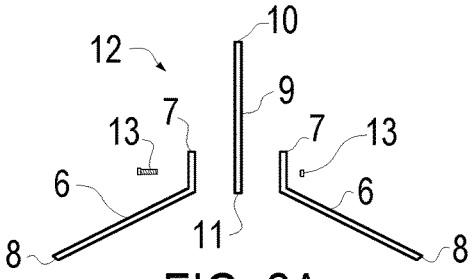
FIG. 2A is a top exploded plan view of one embodiment disclosing a radial metal foundation.
Figure 2B:
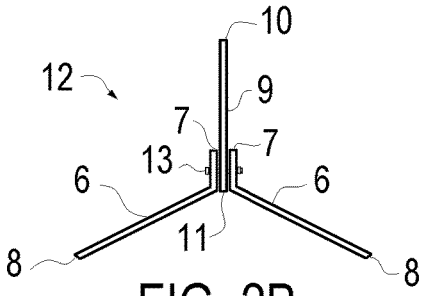
FIG. 2B is a top plan view of the embodiment of FIG. 2A disclosing the assembled radial metal foundation.

FIG. 2 depicts a radial geometric embodiment of the disclosed metal foundation. In FIG. 2B, the radial metal foundation 12 is comprised of three fins that are centrally connected via a mechanical means 13 forming a triangular radial shape. Each of fins 6 has one formed end 7 and a peripheral end 8 and fin 9 is a completely straight fin with a central end 11 and a peripheral end 10. When assembled, each of the formed ends 7 of fins 6 adjoin with the central end 11 of fin 9 to form a geometrically triangular radial metal foundation with three fins. The invention also contemplates the use of greater than three fins in a radial metal foundation. The fins are adjoined by any suitable means known in the art such as Huck Bolts, rivets, clips, bolts, studs clamps or any feasible means known in the art.

Figure 3A:
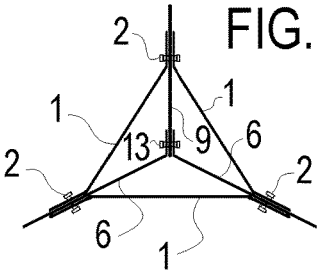
FIG. 3A is a schematic top plan view of a three sided perimeter metal foundation with a three fin radial metal foundation assembly.
Figure 3B:
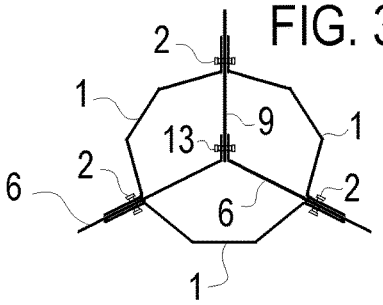
FIG. 3B is a schematic top plan view of a nine sided perimeter metal foundation with a three fin radial metal foundation assembly.
Figure 3C:
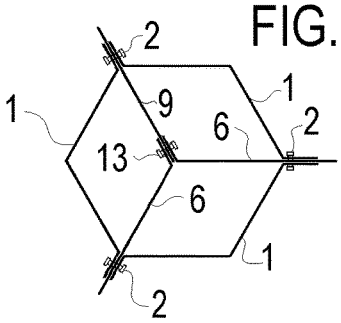
FIG. 3C is a schematic top plan view of a six sided perimeter metal foundation with a three fin radial metal foundation assembly.
Figure 3D:
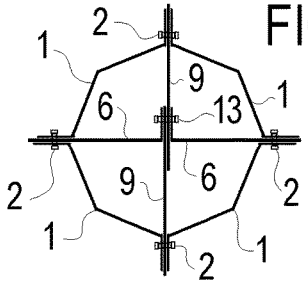
FIG. 3D is a schematic top plan view of an eight sided perimeter metal foundation with a four fin radial metal foundation assembly.
Figure 3E:
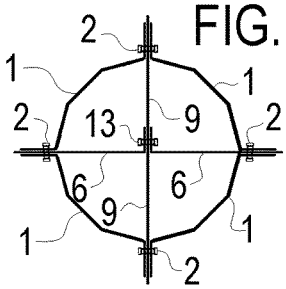
FIG. 3E is a schematic top plan view of a twelve sided perimeter metal foundation with a four fin radial metal foundation assembly.
Figure 3F:
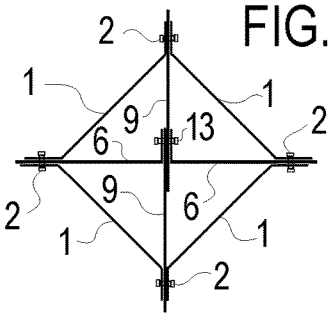
FIG. 3F is a schematic top plan view of a four sided perimeter metal foundation with a four fin radial metal foundation assembly.

The invention also contemplates metal foundations using a combination of both the perimeter and radial geometric designs. Radial geometric foundations can be any number of fins as long as they match the segments of the perimeter foundation bodies. For instance, a three fin radial foundation such as that depicted in FIG. 2B will match any perimeter body shape that is divisible by three as shown by the preferred embodiments depicted in FIGS. 3A-C and a four point radial foundation assembled with only straight fins 9 and fastening means 13 will match any perimeter body shape divisible by four as shown by the preferred embodiments depicted in FIGS. 3D-F. The triangular radial foundation depicted in FIG. 2B is shown in use with a three sided foundation in FIG. 3*a*, a nine sided foundation in FIG. 3*b*, and a six sided foundation in FIG. 3*c*. A four point radial foundation is shown in use with an eight sided foundation in FIG. 3*d*, a twelve sided foundation in FIG. 3*e* and a four sided foundation depicted in FIG. 3*f*. These designs give a very strong and supportive foundation. These are some of the preferred embodiments; the invention is flexible that the pieces can be assembled in any feasible shape needed for a specific project. The fins of the radial metal foundation embodiments connect via the fins of the perimeter metal foundations by any suitable mechanical means such as Huck Bolts, rivets, clips, bolts, studs clamps or any feasible means known in the art.

The disclosed invention allows for a lot of flexibility in engineering designs for foundations. Any practicable size, shape, thickness or length can be accommodated by the disclosed invention. The metal foundations of the disclosed invention can be comprised of sheet or plate steel with any grade and thickness necessary to meet the load requirements of a specific project. The manufacturing methods used to make the bodies of the metal foundation are those commonly known in the art. The metal foundations of the disclosed invention have the advantage of manual assembly, thus eliminating the need for welding. This in turn, eliminates a significant cost in the installation of metal foundations. If small enough, the metal foundations of the disclosed invention can be assembled in one place and transported to the work site. Alternatively for larger foundations, the individual pieces can be transported and manually assembled at the worksite as no special equipment other than that necessary for mechanical fastening is needed. The metal foundations of the disclosed invention can be installed in the ground to any depth by any means known in the art including but not limited to vibrating, pushing, or driving.

The foregoing discussion discloses and describes merely exemplary embodiments of the present invention. One skilled in the art will readily recognize from the accompanying drawings and claims that various changes or modifications can be made without departing from the spirit and scope of this invention. While the invention has been shown in several particular embodiments it should be clear that various modifications may be made to the present invention without departing from the spirit and scope thereof. The scope of the present invention is defined by the appended claims and equivalents thereto.

What is claimed is:

1. A non-welded metal foundation comprising:

a plurality of bodies formed of metal plates or metal sheets, each body being comprised of lateral ends with integrated planar fins, wherein each of the metal lateral ends overlap a lateral end of an adjacent body;

a plurality of mechanical fasteners along each of the overlapped ends of adjacent bodies for mechanically fastening the bodies having the integrated planar fins;

wherein said plurality of said bodies are configured for forming a closed perimeter of a geometrical shape having an open interior and wherein the integrated planar fins of each body extends away from the perimeter of the closed geometric shape along the plane of the fin, wherein each fin has a thickness substantially the same as a thickness of the portion of the body forming the closed perimeter of the geometrical shape, and wherein each fin extend substantially along a single plane from the perimeter of the closed geometric shape, wherein a longitudinally lower end of at least a plurality of the bodies is angled relative to a normal to a longitudinal axis of the body.

2. The metal foundation of claim 1 wherein each body is comprised of sides forming an obtuse angle, wherein the closed geometrical shape is a polygon.

3. The metal foundation of claim 1 wherein each body is arced along a portion thereof forming a cylindrical perimeter geometric design.

4. A non-welded metal foundation comprising:

a plurality of bodies formed of metal plates or metal sheets, each body being comprised of lateral ends with integrated planar fins, wherein each of the metal lateral ends overlap a lateral end of an adjacent body;

a plurality of mechanical fasteners along each of the overlapped ends of adjacent bodies for mechanically fastening the bodies having the integrated planar fins;.

wherein said plurality of said bodies are configured for forming a closed perimeter of a geometrical shape having an open interior and wherein the integrated planar fins of each body extends away from the perimeter of the closed geometric shape along the plane of the fin, wherein each fin has a thickness substantially the same as a thickness of the portion of the body forming the closed perimeter of the geometrical shape, and wherein each fin extend substantially along a single plane from the perimeter of the closed geometric shape, wherein each body on one said lateral end is comprised of a long integrated fin and on a second opposed said lateral end is comprised of a short integrated fin having a length measured from the closed perimeter of the geometrical shape along the single plane less than the long integrated fin, and wherein each long fin of one body is adjacent a short fin of an adjacent body.

* * * * *